US010886655B2

(12) United States Patent
Hwang et al.

(10) Patent No.: US 10,886,655 B2
(45) Date of Patent: Jan. 5, 2021

(54) ELECTRICAL CONNECTOR WITH DIFFERENTLY SHAPED CONTACTS IN MATRIX

(71) Applicants: FOXCONN (KUNSHAN) COMPUTER CONNECtOR CO., LTD., Kunshan (CN); FOXCONN INTERCONNECT TECHNOLOGY LIMITED, Grand Cayman (KY)

(72) Inventors: Tzu-Yao Hwang, New Taipei (TW); Shan-Yong Cheng, New Taipei (TW); Ming-Lun Szu, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/584,967

(22) Filed: Sep. 27, 2019

(65) Prior Publication Data

US 2020/0106203 A1 Apr. 2, 2020

Related U.S. Application Data

(60) Provisional application No. 62/739,160, filed on Sep. 29, 2018.

(51) Int. Cl.
*H01R 13/41* (2006.01)
*H01R 13/24* (2006.01)

(52) U.S. Cl.
CPC ..... *H01R 13/41* (2013.01); *H01R 13/2442* (2013.01)

(58) Field of Classification Search
CPC ..... H01R 13/41
See application file for complete search history.

(56) References Cited

U.S. PATENT DOCUMENTS

| | | | | |
|---|---|---|---|---|
| 6,877,992 | B2 * | 4/2005 | Grant | H01R 13/2435 439/591 |
| 7,074,048 | B2 | 7/2006 | Hong Hai | |
| 8,998,623 | B2 | 4/2015 | Hong Hai | |
| 9,214,764 | B2 | 12/2015 | Hong Hai | |
| 2011/0070750 | A1 * | 3/2011 | Reisinger | H01R 13/2442 439/66 |
| 2018/0175538 | A1 | 6/2018 | Wu et al. | |
| 2018/0375243 | A1 | 12/2018 | Hsu | |
| 2019/0089098 | A1 | 3/2019 | Cheng et al. | |

* cited by examiner

*Primary Examiner* — Ross N Gushi
(74) *Attorney, Agent, or Firm* — Wei Te Chung; Ming Chieh Chang

(57) ABSTRACT

An electrical connector includes an insulative housing with a plurality of contacts retained therein in matrix wherein all the contacts are of the cantilevered spring arm type for connecting to the conductive pads of the CPU while categorized with at least two different types for performing different functions, i.e., signal transmission or power delivery. The different type may be related to the corresponding dimension/thickness, the configuration/position, the material, and the processing method which alters the mechanical or electrical characters of the contacts, etc. The different type contacts having the contact points initially at different heights while eventually at the same height, is another feature of the invention.

15 Claims, 26 Drawing Sheets

5

5

5

ELECTRICAL CONNECTOR WITH DIFFERENTLY SHAPED CONTACTS IN MATRIX

BACKGROUND OF THE DISCLOSURE

1. Field of the Disclosure

The invention relates to the electrical connector for use with the CPU (Central Processing Unit), and particularly to the electrical connector equipped with the different type contacts in matrix for performing signal transmission, power delivery and grounding.

2. Description of Related Arts

The traditional socket for retaining the CPU are shown in U.S. Patent Application Publication No. 2018/0175538, U.S. Pat. Nos. 9,214,764, 8,998,623 with therein the relatively great amount contacts, i.e., more than three thousand contacts. The structures of the housing and the corresponding contacts can be referred to the copending patent applications Ser. No. 16/014,519 filed on Jun. 21, 2018, Ser. No. 16/134,928 filed on Sep. 18, 2018 for the earlier U.S. Pat. No. 7,074,048. Anyhow, because the amount of the contacts is inevitably increased for performing the high speed and high frequency transmission and the minimum normal force is required between the conductive pads of the CPU and the contacts respectively, the total loading force of the CPU upon the socket becomes incredibly large. Notably, in the traditional CPU socket all the contacts, which respectively perform different functions, i.e., signal transmission, power delivering and grounding, are essentially of the same type and arranged in matrix. It is also noted that the contacting normal force between the signal contact of the socket and the corresponding conductive pad of the CPU may be relatively important compared with that between the power contact of the socket and the corresponding conductive pad of the CPU. Therefore, a new arrangement the contacts of the electrical connector to lower the total loading force of the CPU is one approach of the future trend. Some attempts have been made by installing two different type contacts in one socket for performing signal transmission and power delivery, respectively.

An improved electrical connector is desired.

SUMMARY OF THE DISCLOSURE

Accordingly, one object of the present disclosure is to provide an electrical connector for use with the LGA (Land Grid Array) CPU, which may includes a relatively large contact amount while still allow a relatively low loading force of the CPU.

To achieve the above object, an electrical connector includes an insulative housing with a plurality of contacts retained therein in matrix wherein all the contacts are of the cantilevered spring arm type for connecting to the conductive pads of the CPU while categorized with at least two different types for performing different functions, i.e., signal transmission or power delivery. The different type may be related to the corresponding dimension/thickness, the configuration/position, the material, and the processing method which alters the mechanical or electrical characters of the contacts, etc. The different type contacts having the contact points initially at different heights while eventually at the same height, is another feature of the invention. Understandably, because of the different type contacts, the method of assembling the contacts into the housing of the socket may be changed in comparison with that in the traditional socket which has only one type contacts therein.

Other objects, advantages and novel features of the disclosure will become more apparent from the following detailed description when taken in conjunction with the accompanying drawings.

DETAILED DESCRIPTION OF THE PREFERRED EMBODIMENT

Figure 1A:
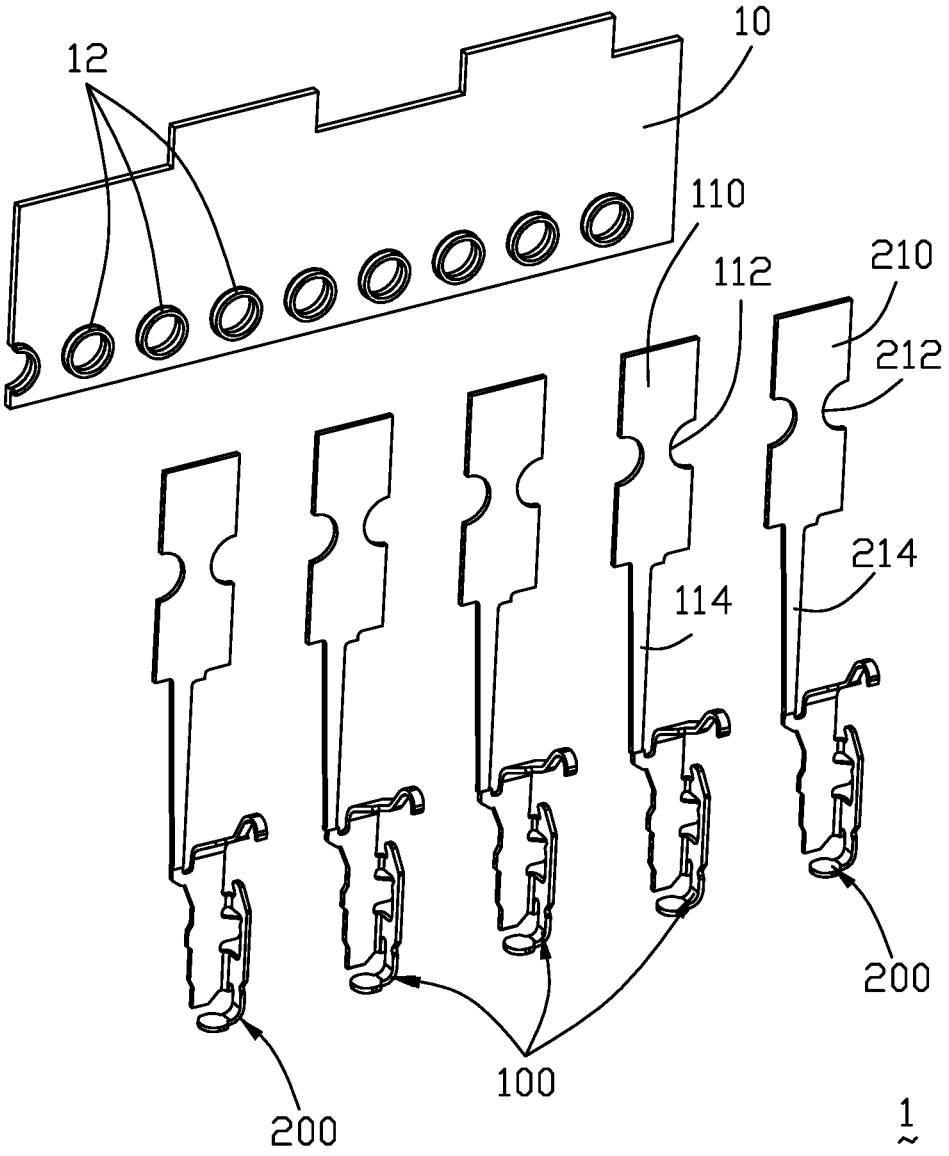
FIG. 1(A) is an exploded perspective view of a contact assembly according to a first embodiment of the invention.
Figure 1B:
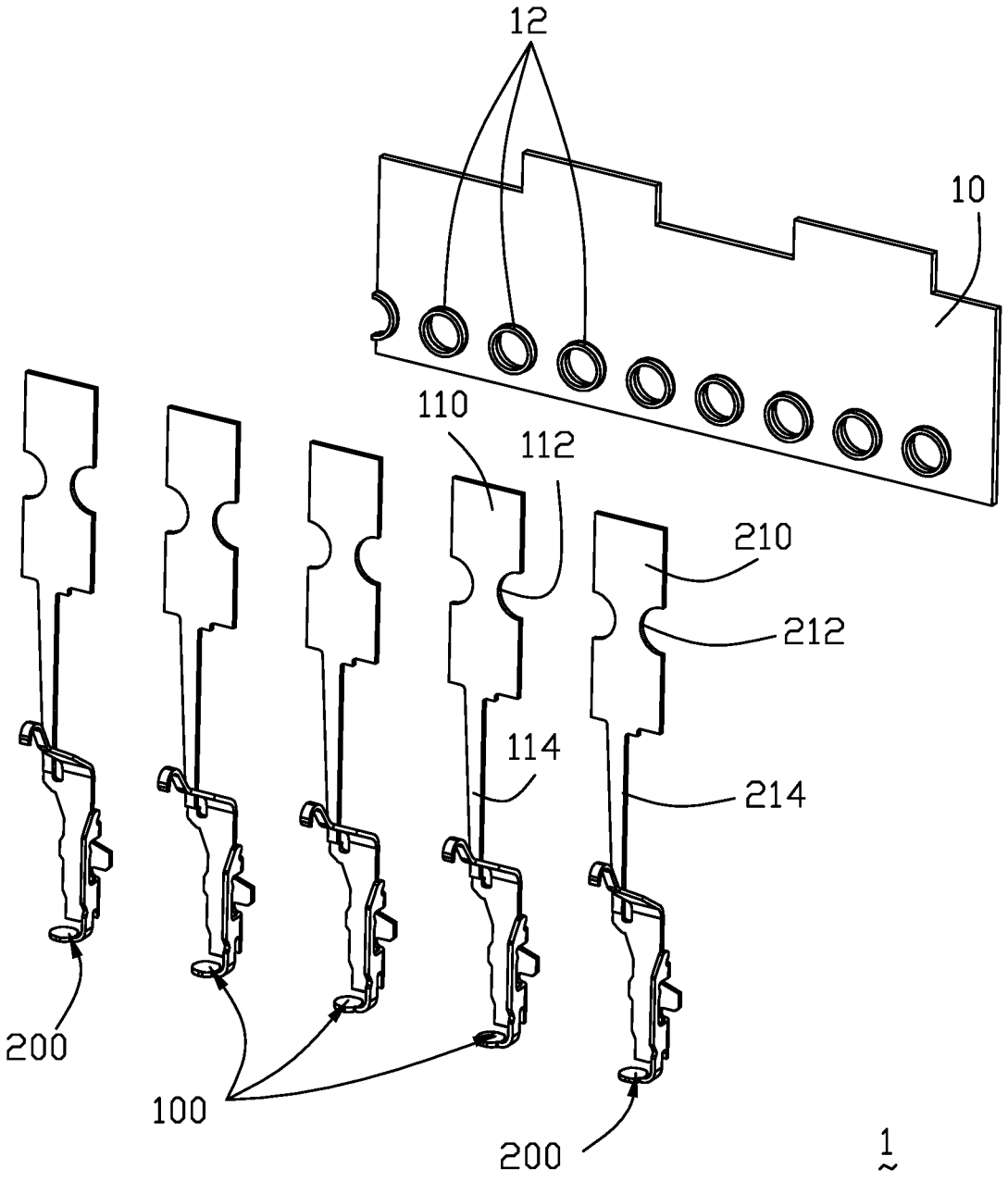
FIG. 1(B) is another exploded perspective view of the contact assembly of FIG. 1(A)
Figure 2A:
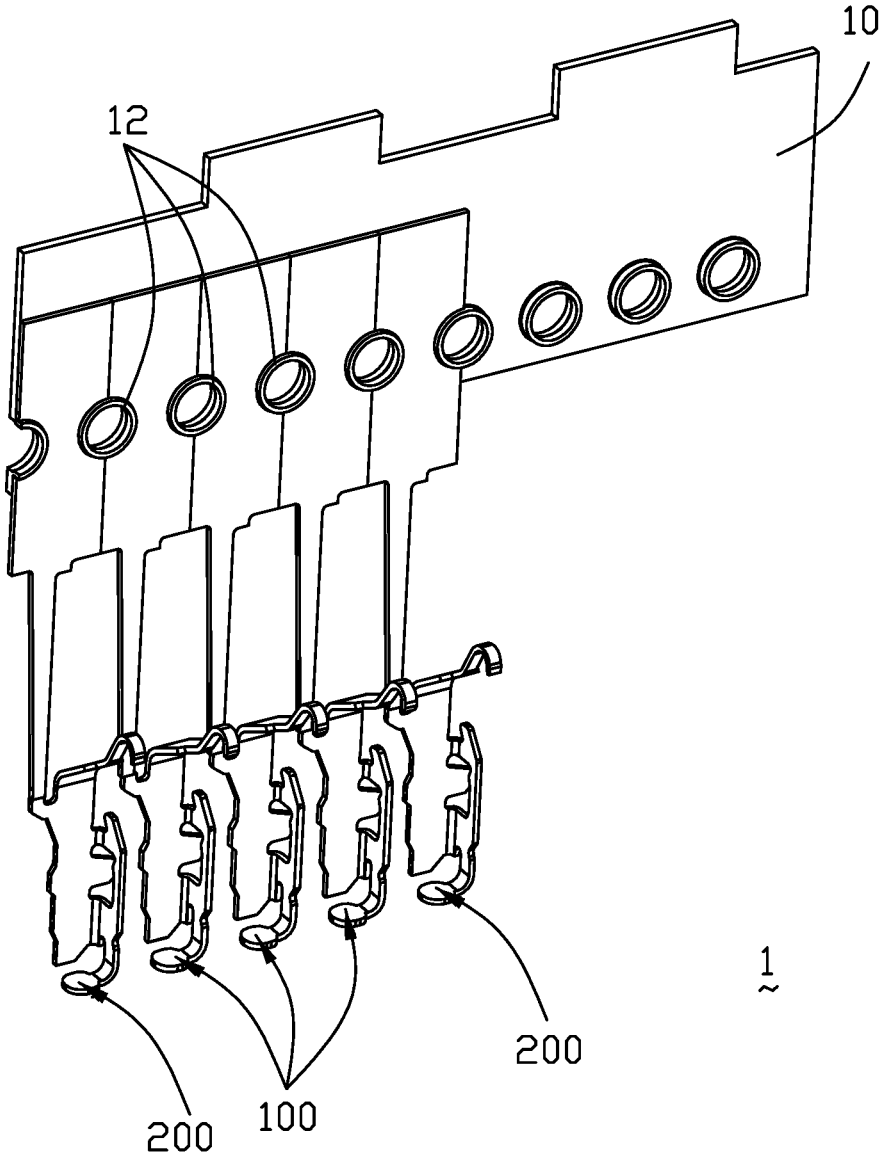
FIG. 2(A) is an assembled perspective view of the contact assembly of FIG. 1(A)
Figure 2B:
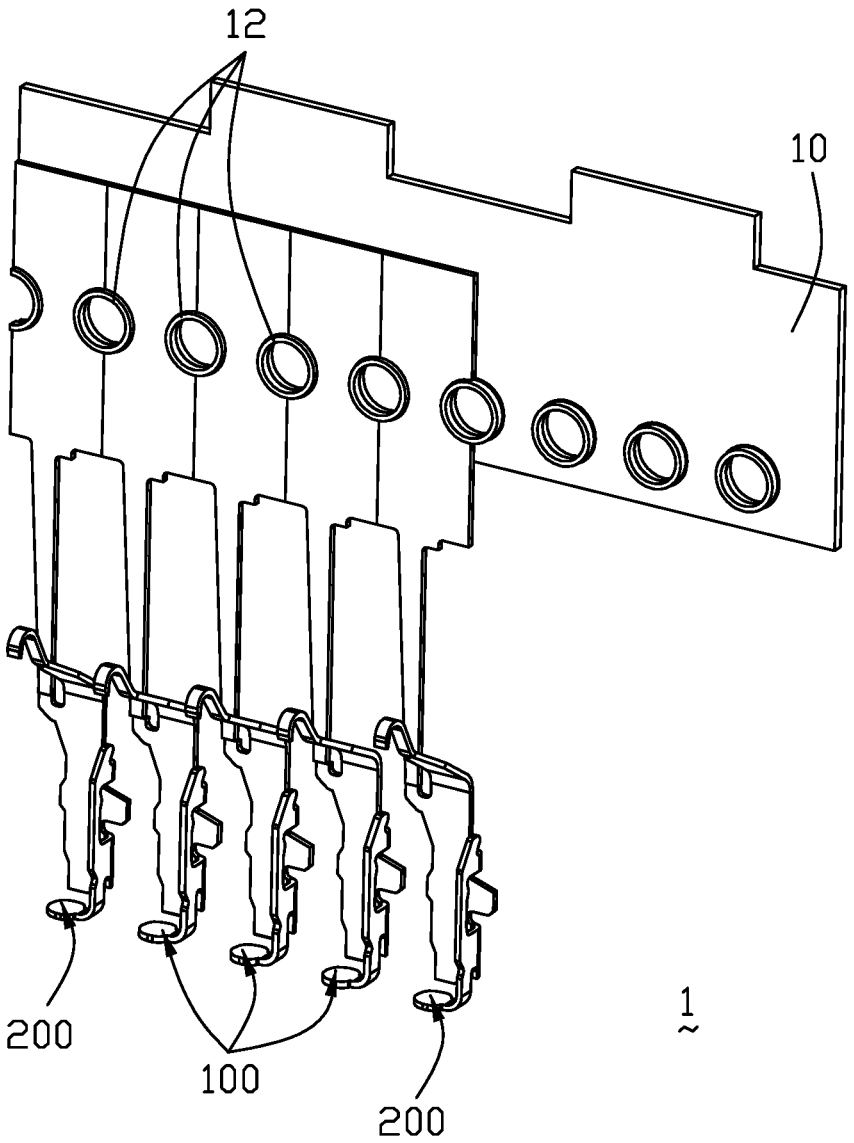
FIG. 2(B) is another assembled perspective view of the contact assembly of FIG. 2(A)
Figure 3:
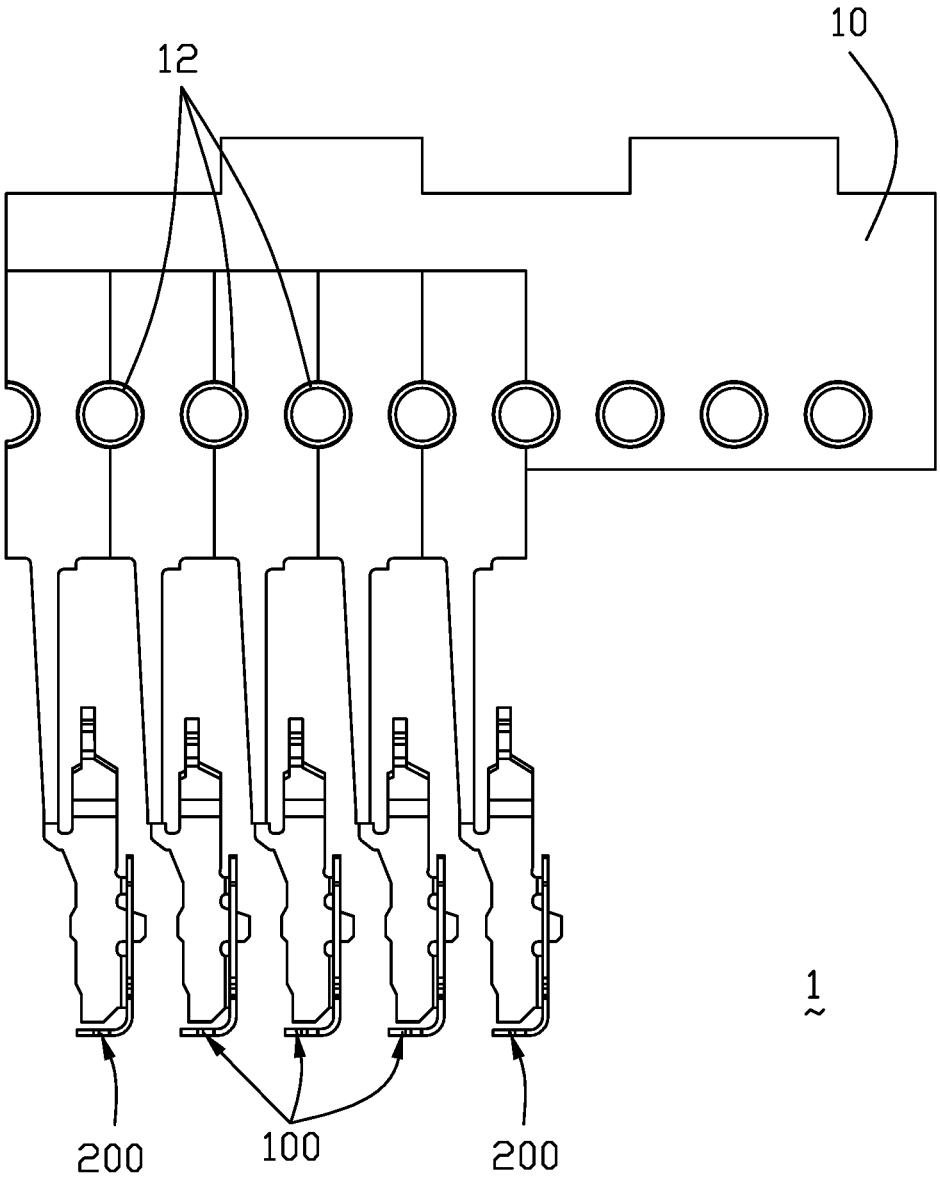
FIG. 3 is an elevational view of the contact assembly of FIG. 2.
Figure 4:
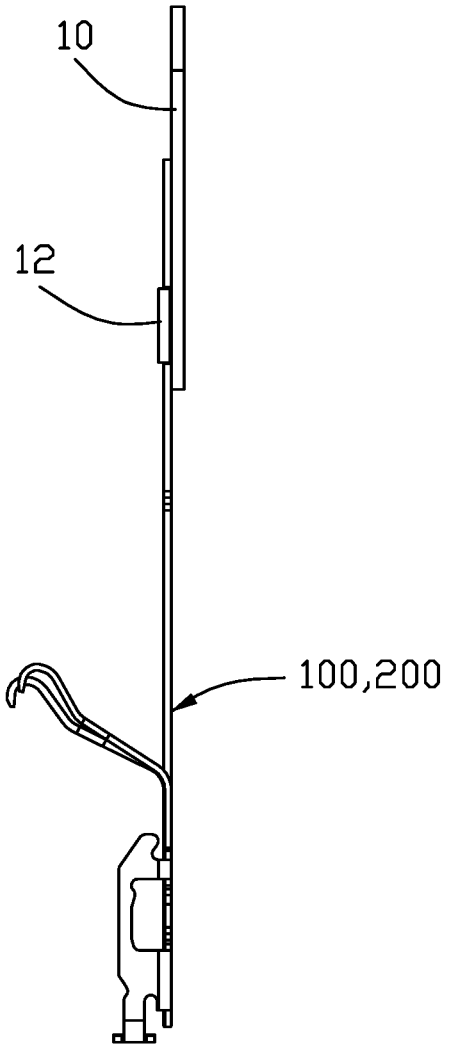
FIG. 4 is a side view of the contact assembly of FIG. 2.
Figure 5A:
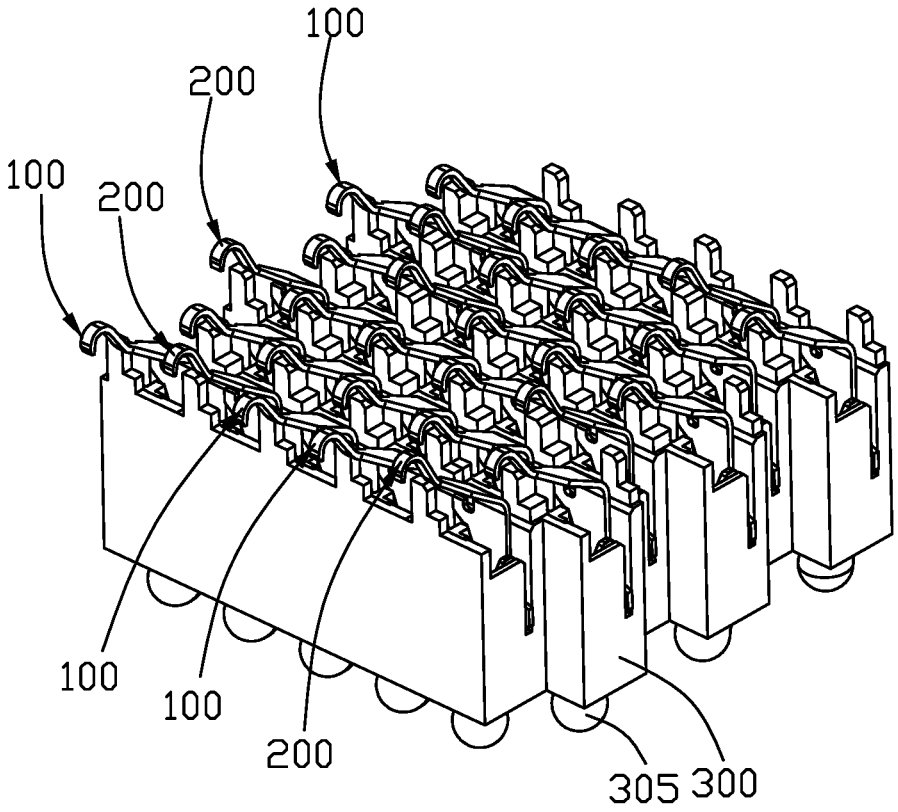
FIG. 5(A) is an assembled perspective view of the electrical connector with the corresponding contacts of FIG. 1(A)
Figure 5B:
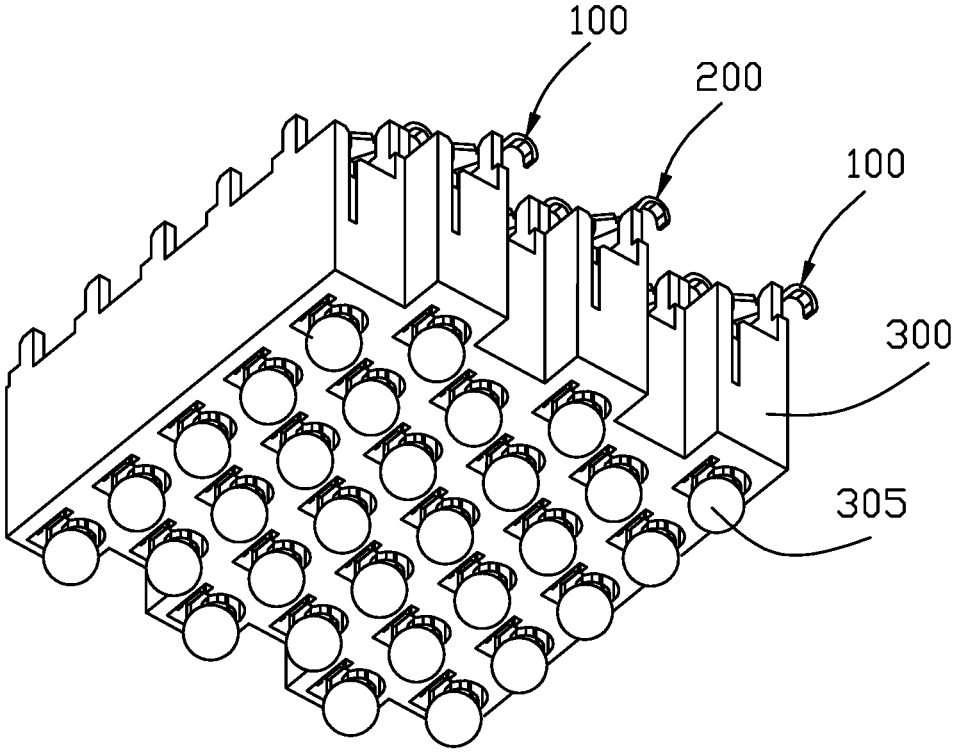
FIG. 5(B) is another assembled perspective view of the electrical connector of FIG. 5(A)
Figure 6:
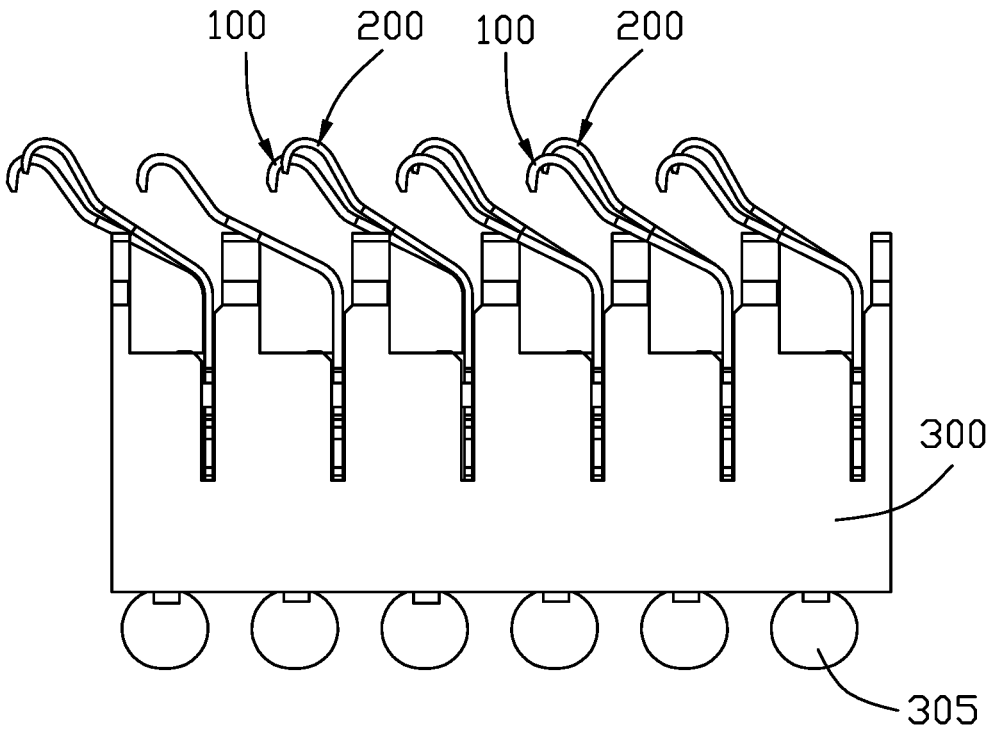
FIG. 6 is a side view of the electrical connector of FIG. 5(A)

Referring to FIGS. 1(A)-10(B), an electrical connector 5 includes an insulative housing 300 with a plurality of passageways 310 arranged in matrix and extending through opposite top and bottom surfaces of the housing 300. Each passageway 310 further includes a through type retention slot 320 and a step type retention slot 330 on two sides in a transverse direction. The housing 300 further forms a plurality of upstanding posts 340 for separating the spring arms of the contacts when the spring arms is pressed downwardly by the CPU.

A plurality of first contacts with the first type and a plurality of second contacts with the second type are disposed in the corresponding passageways 310, respectively. The first contact is originally linked with the corresponding carrier or holding part 110 totally with the reference numeral 100 which refers to the so-called first contact assembly. The first contact includes a first main body 120 with corresponding first retention barbs 130, 132 on two sides to be engaged within the corresponding retention slots 330, 320, respectively. A first spring arm 124 extends upwardly and obliquely from an upper end of the first main body 120 with a first contacting section 126 around a free end thereof. A first auxiliary body 122 extends from a side edge of the first main body 120 with a first soldering pad 128 at the lower end. A solder ball 305 is attached on an undersurface of the first soldering pad 128. The first carrier 110 has a first extension 114 linked with an upper end of the first main body 120 and a first holding section 112 secured to the corresponding holding ring 12 of the fixture or assembling part 10 for assembling the first contact into the corresponding passageway 310.

Similarly, the second contact is originally linked with the second carrier 210 totally with the reference numeral 200 which refers to the so-called second contact assembly. The second contact includes a second main body 220 with corresponding second retention barbs 230, 232 on two sides to be engaged within the corresponding retention slots 330, 320, respectively. A second spring arm 224 extends upwardly and obliquely from an upper end of the second main body 220 with a second contacting section 226 around a free end thereof. A second auxiliary body 222 extends from a side edge of the second main body 220 with a second soldering pad 228 at the lower end. A solder ball 305 is attached on an undersurface of the second soldering pad 228. The second carrier 210 has a second extension 214 linked with an upper end or edge E of the second main body 220 and a second holding section 212 secured to the corresponding holding ring 12 of the fixture 10 for assembling the second contact into the corresponding passageway 310.

Figure 7A:
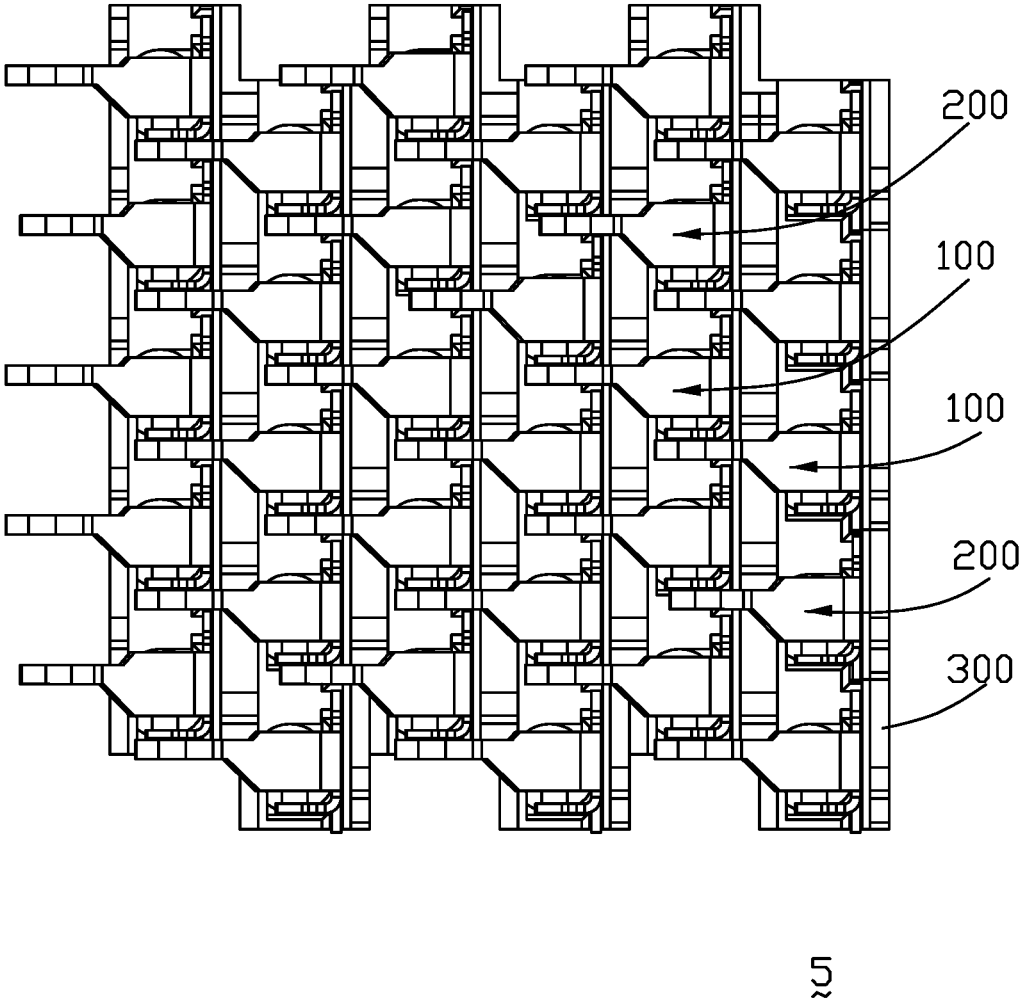
FIG. 7(A) is a top view of the electrical connector of FIG. 5(A)
Figure 7B:
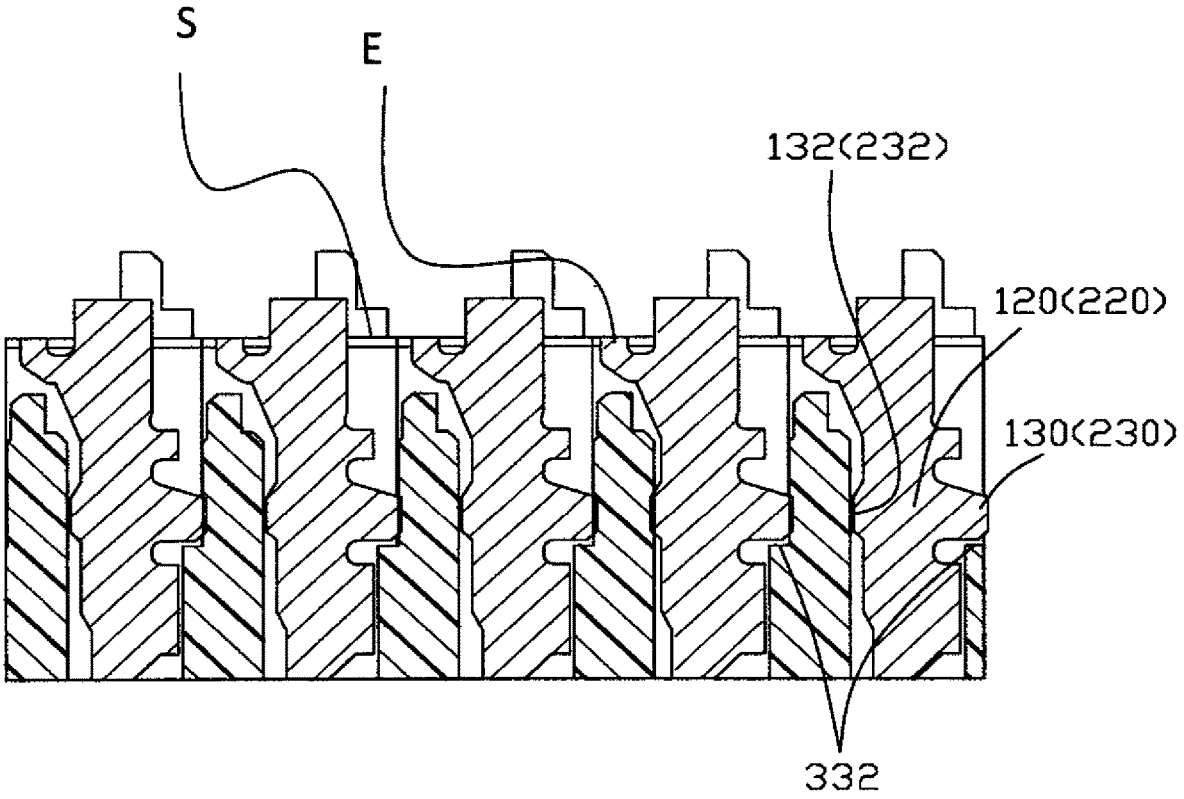
FIG. 7(B) is a cross-sectional view of the electrical connector of FIG. 5(A)
Figure 7C:
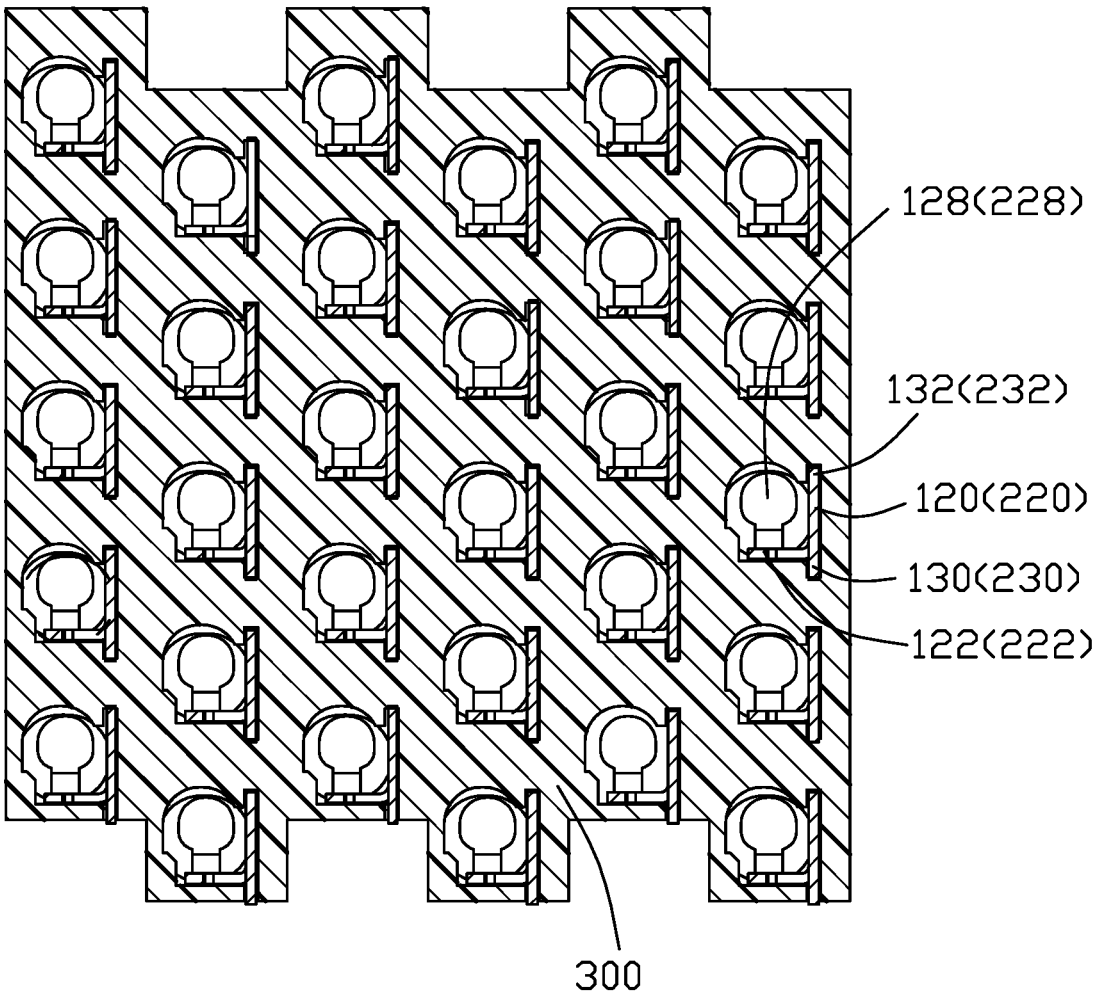
FIG. 7(C) is another cross-sectional view of the electrical connector of FIG. 5(A)
Figure 8A:
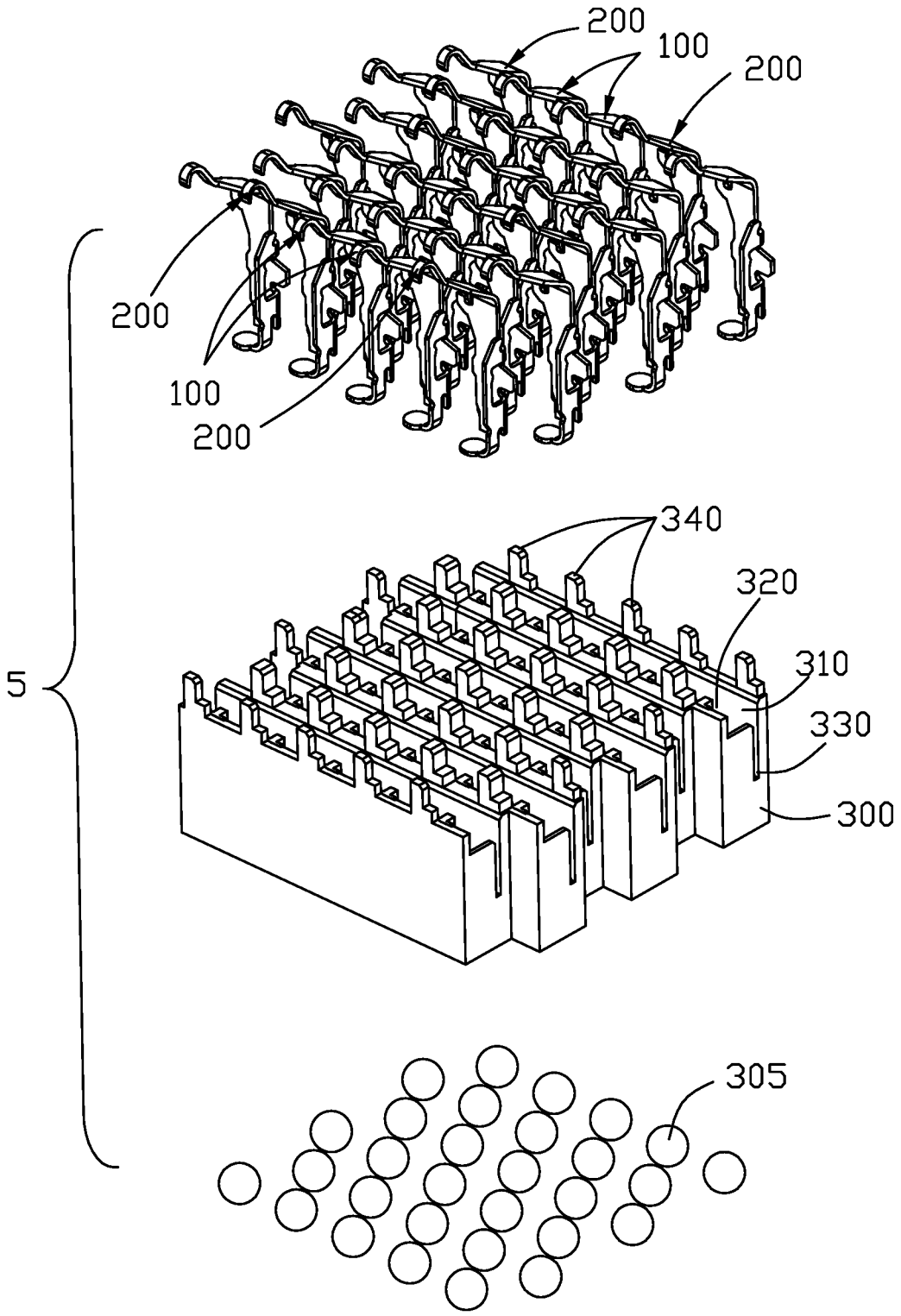
FIG. 8(A) is an exploded perspective view of the electrical connector of FIG. 5(A)
Figure 8B:
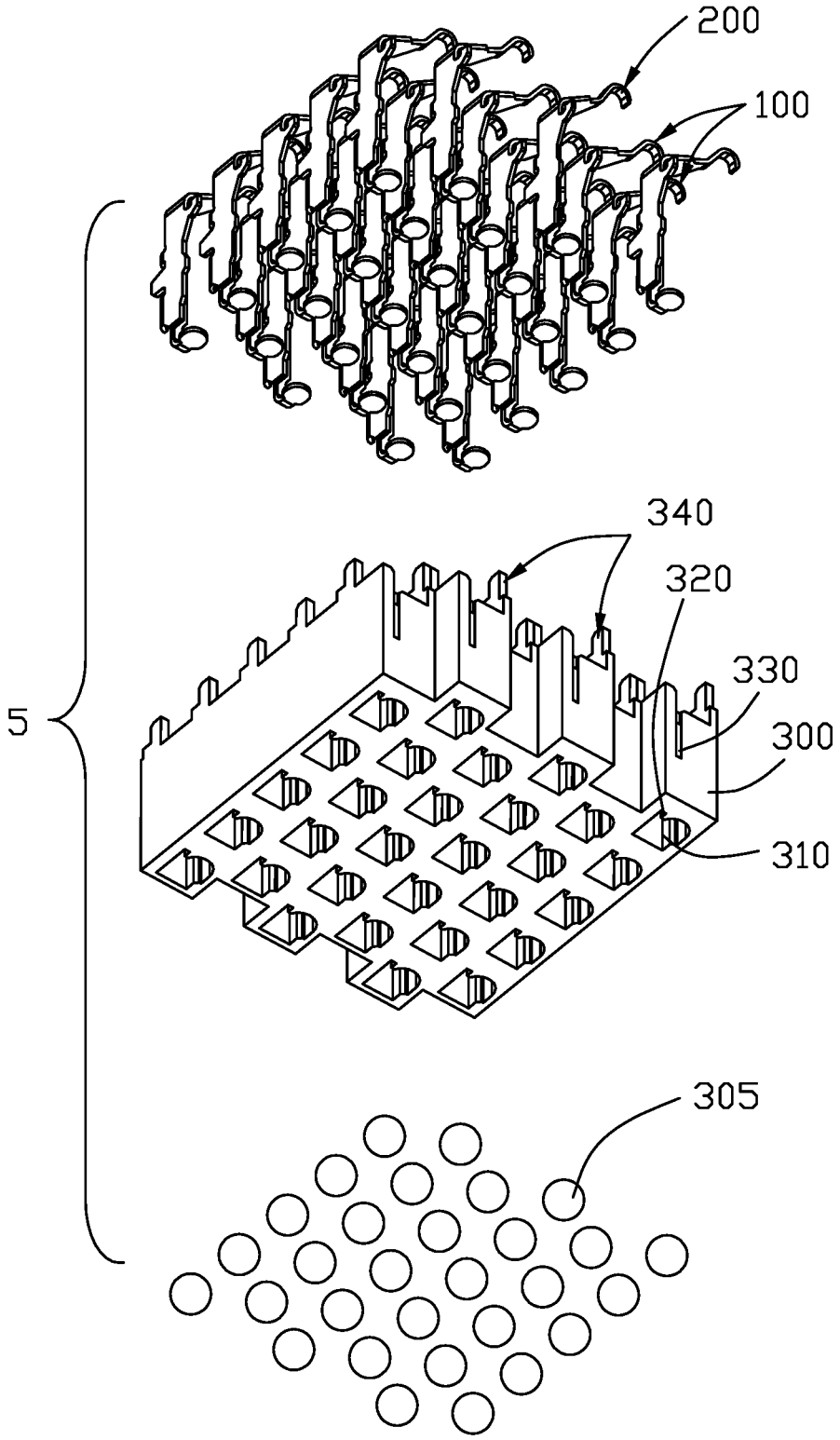
FIG. 8(B) is another exploded perspective view of the electrical connector of FIG. 8(A)
Figure 8C:
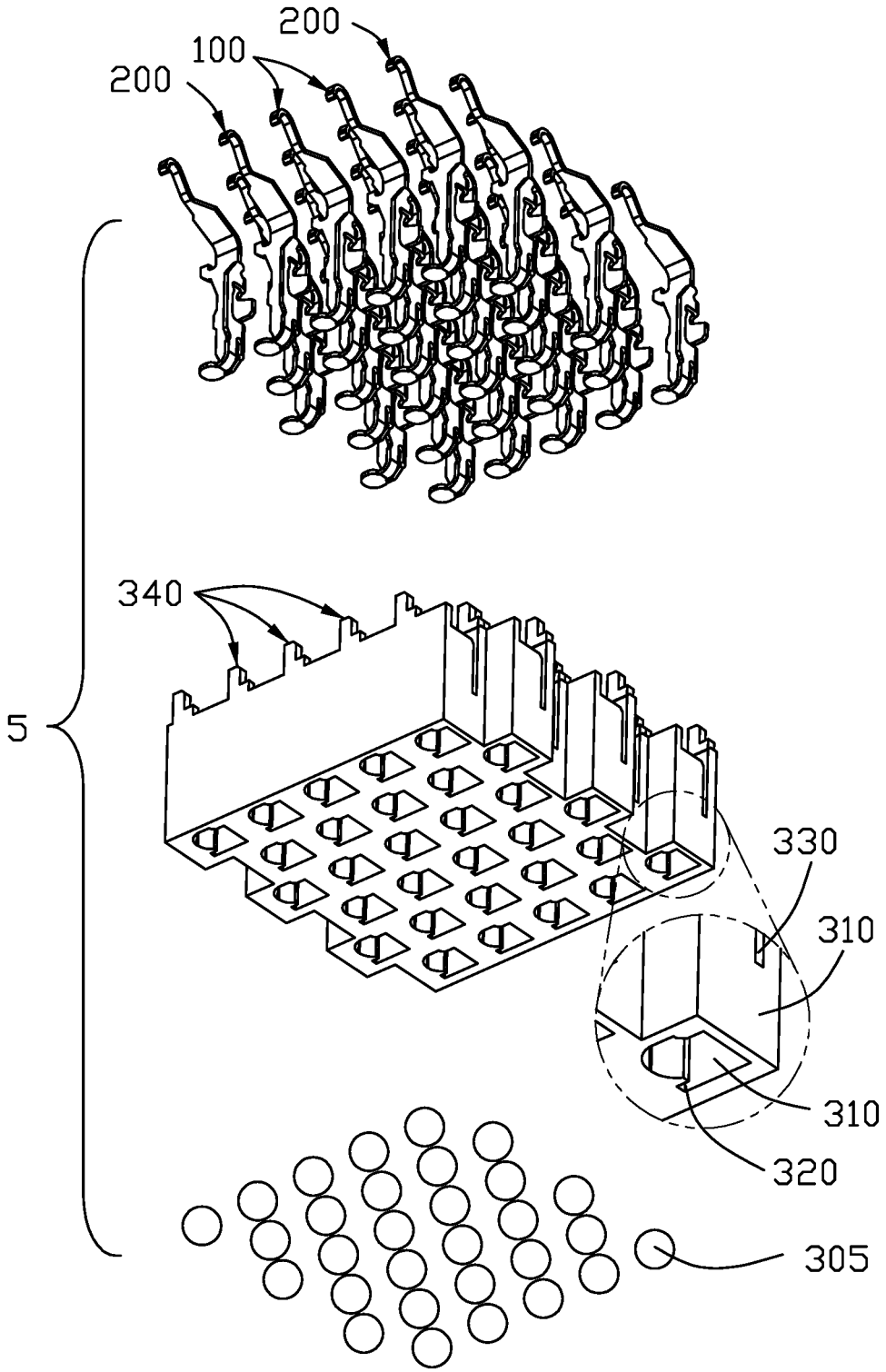
FIG. 8(C) is another exploded perspective view of the electrical connector of FIG. 8(A)
Figure 9:
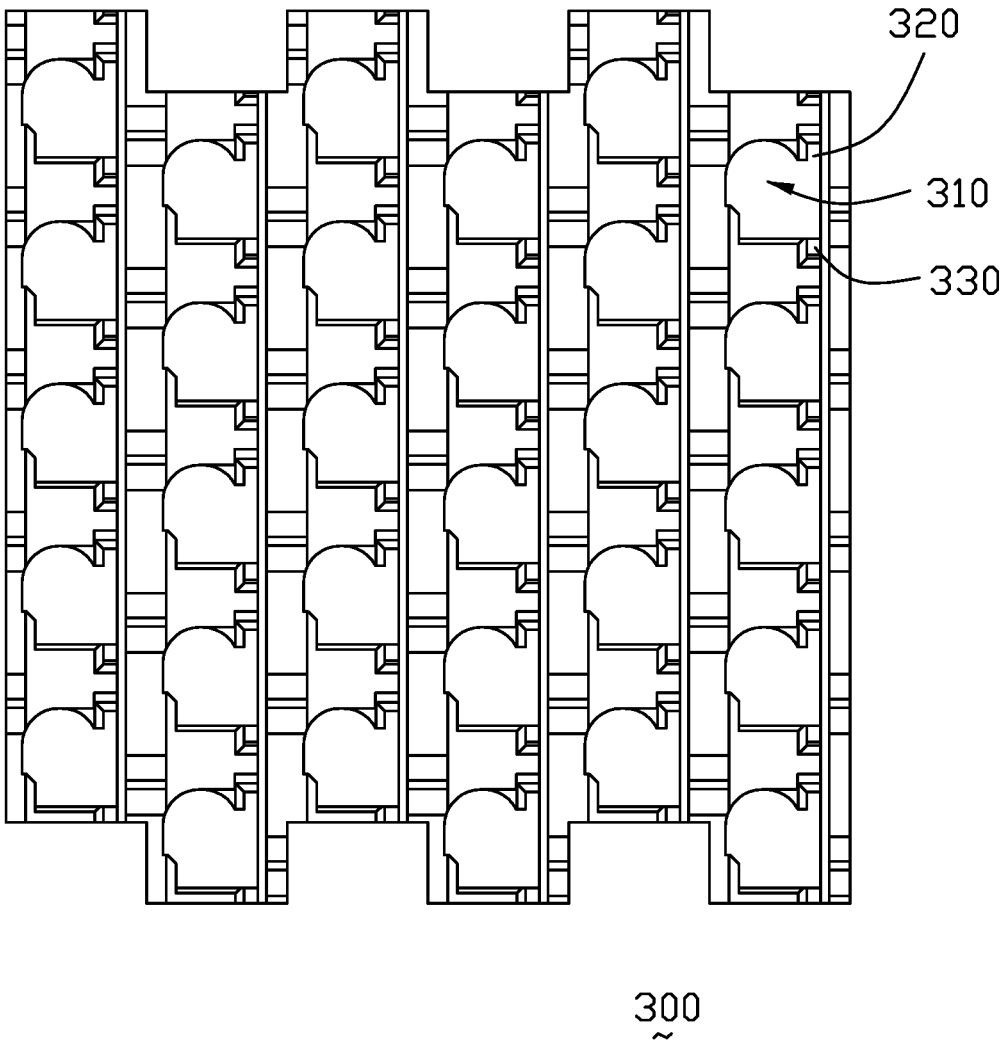
FIG. 9 is a top view of the housing of the electrical connector of FIG. 5(A)
Figure 10A:
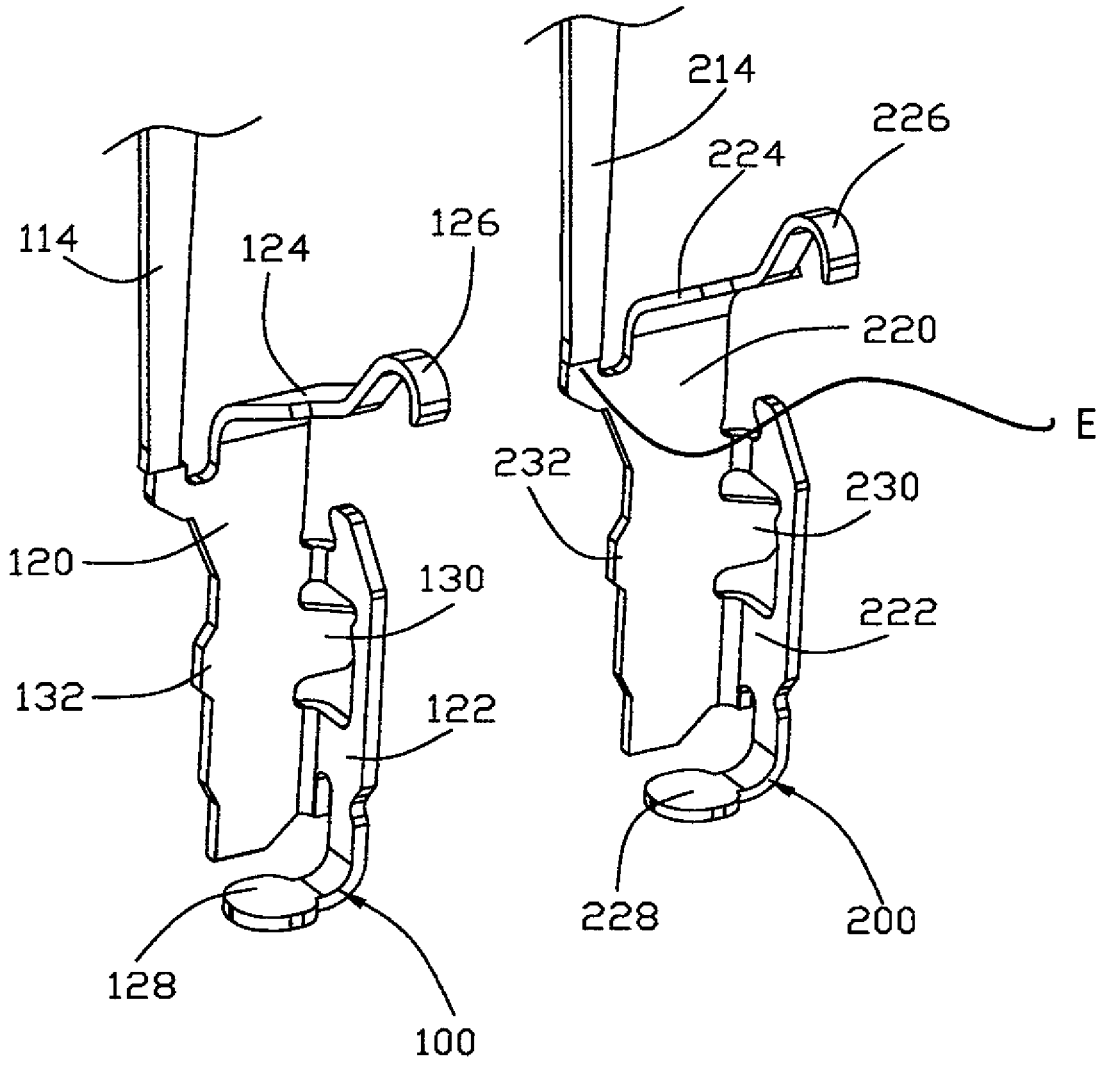
FIG. 10(A) is a perspective view to show a single unit of the contact assembly of FIG. 1(A)
Figure 10B:
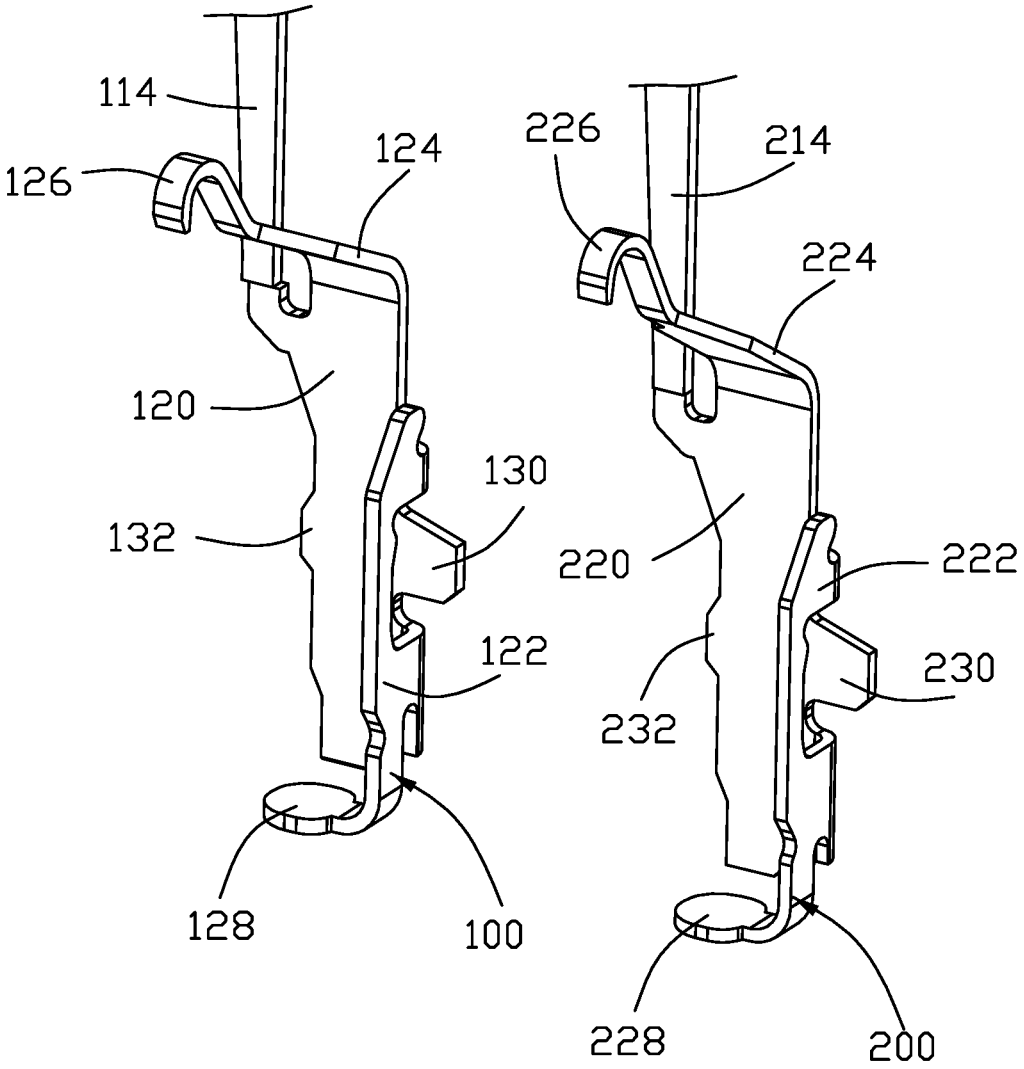
FIG. 10(B) is another perspective view of the signal unit of the contact assembly of FIG. 10(A)
Figure 11:
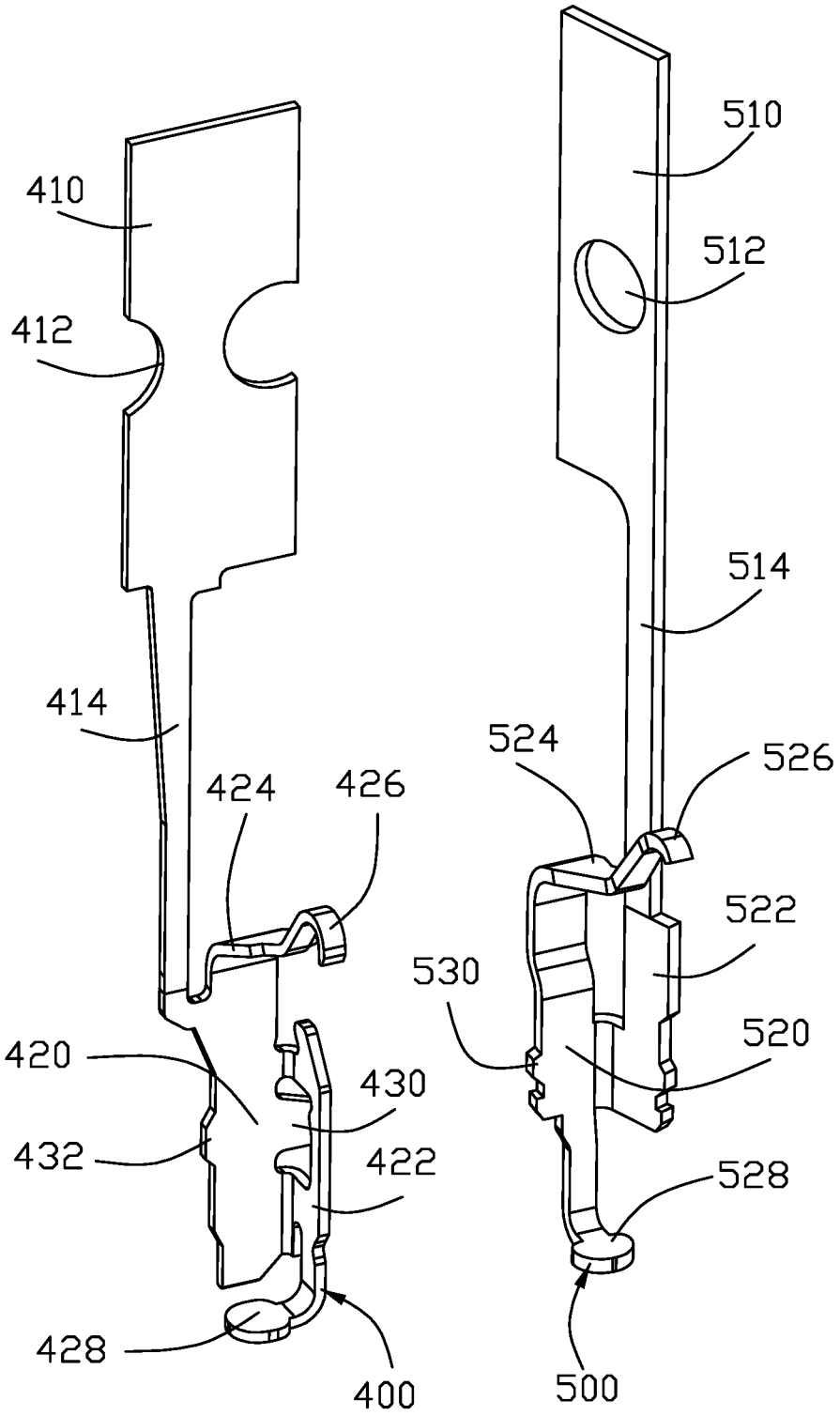
FIG. 11 is a perspective view of the signal unit of the contact assembly according to a second embodiment of the invention.
Figure 12:
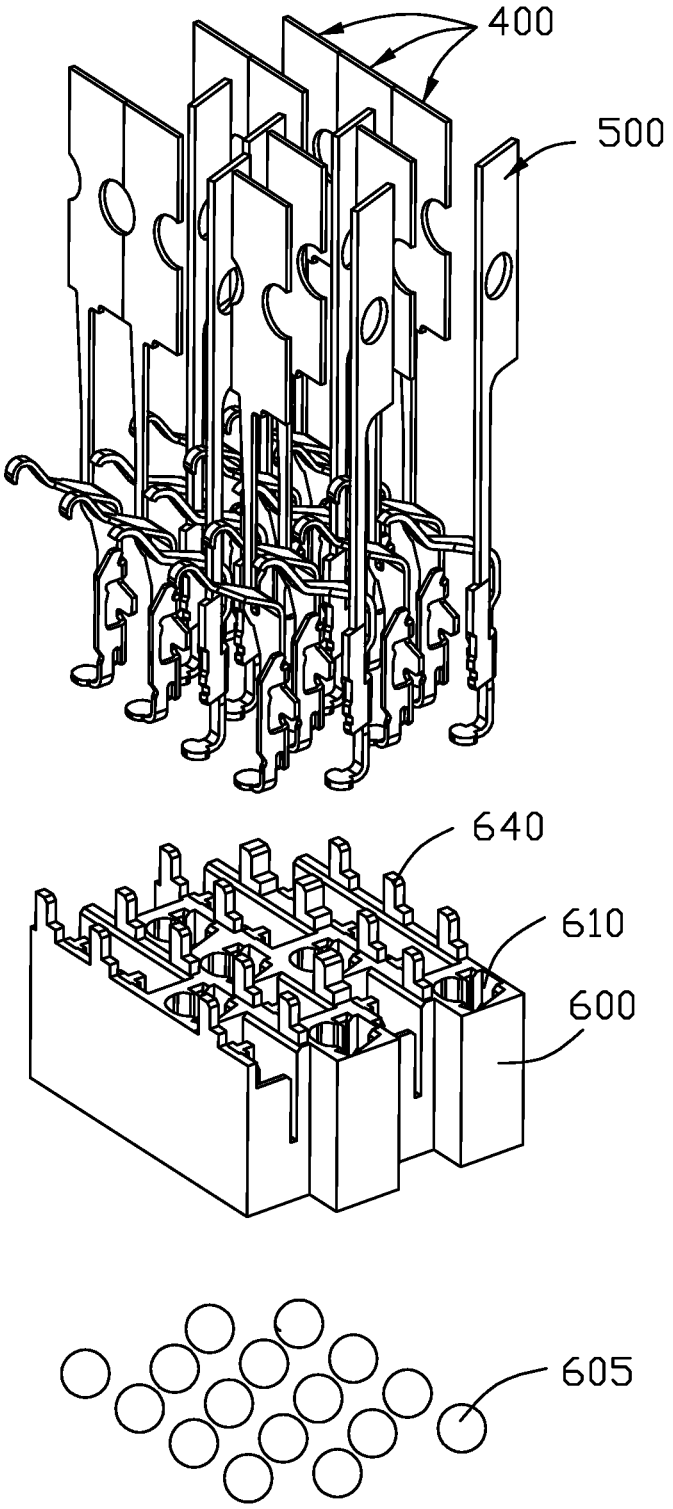
FIG. 12 is an exploded perspective view of the electrical connector assembly equipped with the contact assembly of FIG. 11.
Figure 13:
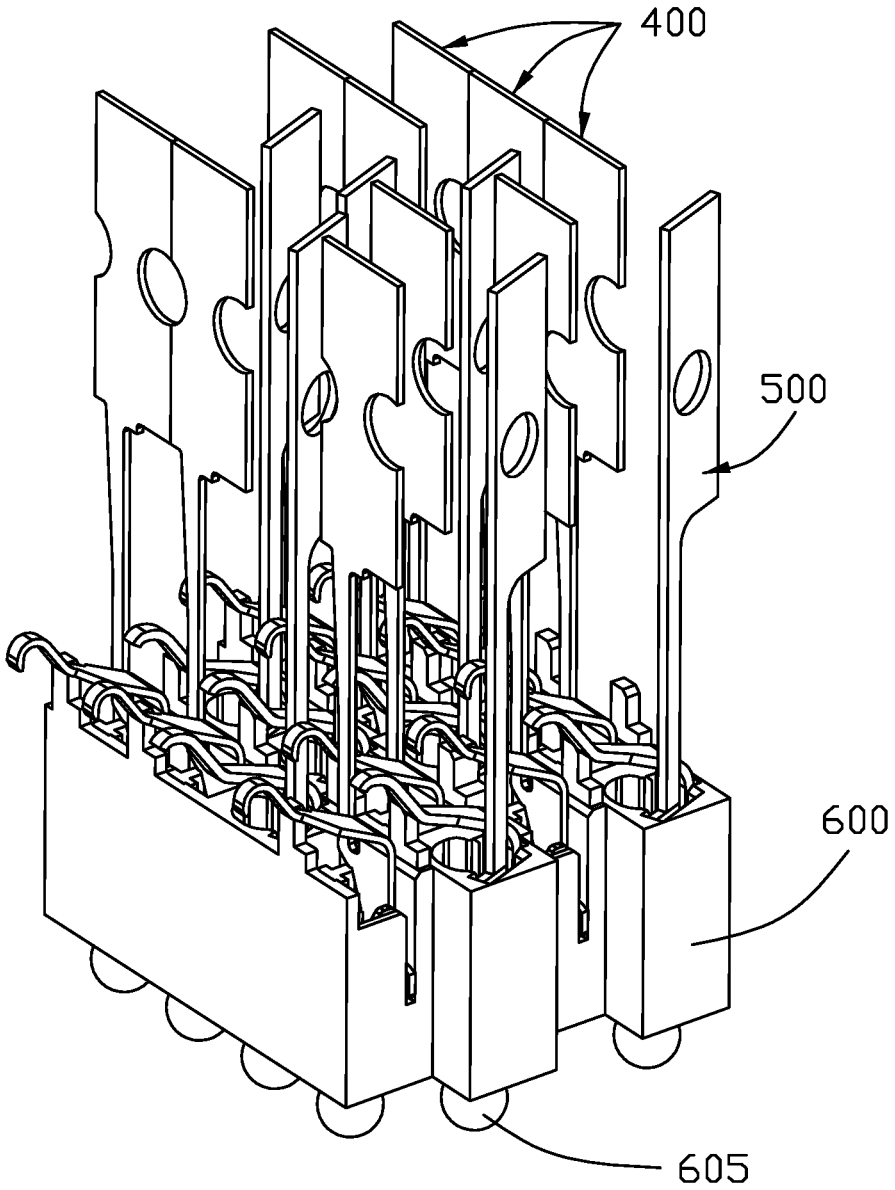
FIG. 13 is an assembled perspective view of the electrical connector assembly of FIG. 12.
Figure 14:
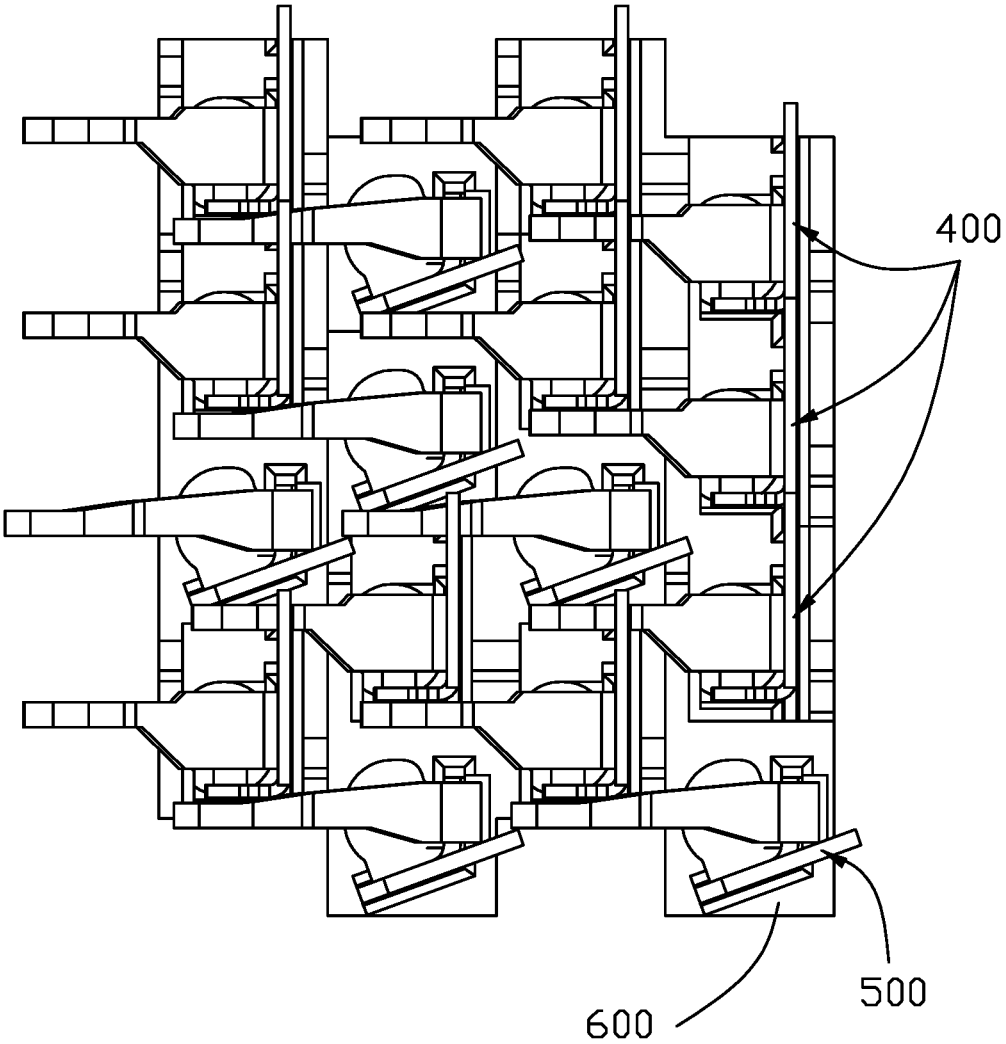
FIG. 14 is a top view of the electrical connector assembly of FIG. 12.

In this embodiment, the second contacting section 226 is higher than the first contacting section 126 when no CPU is loaded upon the housing 300 and the contact is in a relaxed manner. Therefore, when the CPU is mounted upon the connector 5, the second contacting section 226 of the second contact will contact the corresponding conductive pad of the CPU before the first contacting section 126 of the first contact. Anyhow, once the CPU is fully mounted upon the housing 300, both the first contacting section 126 and the second contacting section 226 are located at the same height in a compressed manner. In this embodiment, the second contact is the power contact and the first contact is the signal contact. Notably, in this embodiment, one feature of the invention is for mechanical consideration to have the thickness of the second contact is smaller than that of the first contact so as to achieve the lower normal force than the first contact even if the deflection of the second contact is larger than the first contact. Understandably, the second contact may be thicker than the first contact for electrical consideration while the configuration or the dimension of the second contact may be modified so as to still achieve the smaller normal force than the first contact. In this embodiment, both the first contacts with the corresponding first carrier 110 and the second contacts with the corresponding second carrier 210 are commonly secured to the same fixture 10 to be simultaneously assembled into the corresponding passageways 310 of the housing 300, respectively. As shown in FIG. 10(A), the second main body 220 of the second contact has an upward connecting edge E, which is located adjacent to the second spring arm 224, to connect to the corresponding second extension 214 of the second carrier 210. In addition, as shown in FIG. 7(B), the connecting edge E is essentially flush with a top surface S of the housing 300 for facilitating separation of the second carrier 210 from the second contact. Notably, the first contact has a similar structure as well for the same purpose.

Referring to FIGS. 11-14 showing the second embodiment, the first contact, which is similar to that in the first embodiment, has the first main body 420 with the first retention barbs 432 and 430 on two sides. A first spring arm 424 extends from an upper end of the main body 420 with a first contacting section 426 around a free end. A first auxiliary body 422 extends from a side edge of the first main body 420 with a first soldering pad 428 at the bottom end thereof for securing a solder ball 605 thereto. The first contact is originally linked with the first carrier 410 totally with the reference numeral 400. The first carrier 410 has a first extension 414 linked to the upper end of the first main body 420 and a first holding section 412 for securing to the corresponding fixture (not shown).

The second contact, which is significantly different from the first contact in comparison with the similarity between the first contact and the second contact in the first embodiment, has a second main body 520 with a retention bar 530 on one side. A second spring arm 524 extends from an upper end of the second main body 520 with a second contacting section 526 around a free end thereof. A second auxiliary body 522 extends from a side edge of the second main body 520 with another retention bar (not labeled) on one side. Different from the first embodiment, in the second contact assembly 500 the second soldering pad 528 extends from the bottom end of the second main body 520 for securing the solder ball 605 thereto, and the second carrier 510 with the corresponding holding section 512 therein and the corresponding second extension 514 is linked to an upper end of the second auxiliary body 522.

In the second embodiment, the plural first contact assemblies 400 are commonly secured to the fixture for simultaneously assembling into the corresponding passageways 610 of the housing as what is done in the first embodiment. Anyhow, the second contact assembly 500 is individually assembled into the corresponding passageway 610 in the housing 600. Notably, the direction of the first carrier 410 is different from that of the second carrier 510 in an oblique relation. Understandably, if possible, some of the second contact assemblies 500 may be aligned with one another for common installation into the corresponding passageways of the housing, as performed by the first contact assembly 400 even if the first contact carrier 410 and the second contact carrier 510 have different/angled orientation directions. Notably, the second contact assembly 500 may be assembled into the corresponding passageway 610 after the first contact assembly 400 has been assembled into the corresponding passageway 610 without improper interference.

Notably, in the second embodiment, the passageway 610 receiving the first contact is different from that receiving the second contact. Anyhow, as long as the configurations of the two different type contacts are not significantly different from each other, the passageways for receiving the two different type contacts may be arranged to be of the similar or even the same type so as to perfect the molding consideration. Understandably, in the first embodiment even though the first type contact and the second type contact are slightly different from each other, i.e., the different thicknesses and the different deflections of the spring arms, the corresponding passageways are shared with each other.

Additional, the signal contacts are sensitive to the normal force compared with the power/grounding contacts because the latter are arranged in parallel. Under this situation, using at least two different type contacts in the same socket, using the two type contacts evenly with different regions performing different functions or even in a random arrangement, are different approaches. Anyhow, by using two different type contacts, the signal contacts may be of the relatively expensive type referring to the material or manufacturing cost while the power/grounding contacts may be of the relatively inexpensive type. Understandably, in the existing sockets the signal contacts may be surrounded by the power/grounding contacts for EMI shielding consideration. The different type power/grounding contacts may enhance such shielding effect, if properly arranged.

Figure 15:
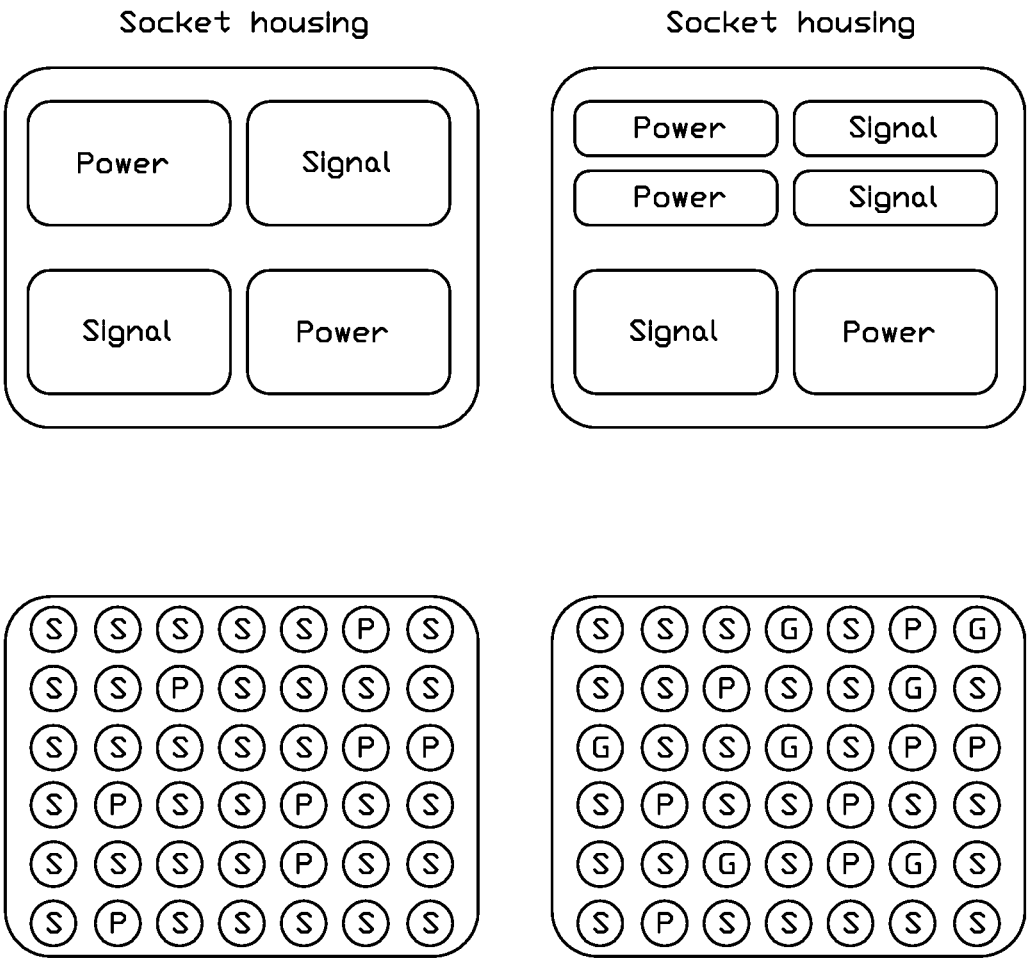
FIG. 15 shows the three different approaches by using two different type contacts.

FIG. 15 shows three ways for the arrangement of the signal contacts and the power contacts with different types in the same socket. The first way refers to the different regions/blocks either with large regions or smaller regions. The second way refers to a random arrangement. The third way refers to more than two type contacts, i.e., at least three.

Figure 16:
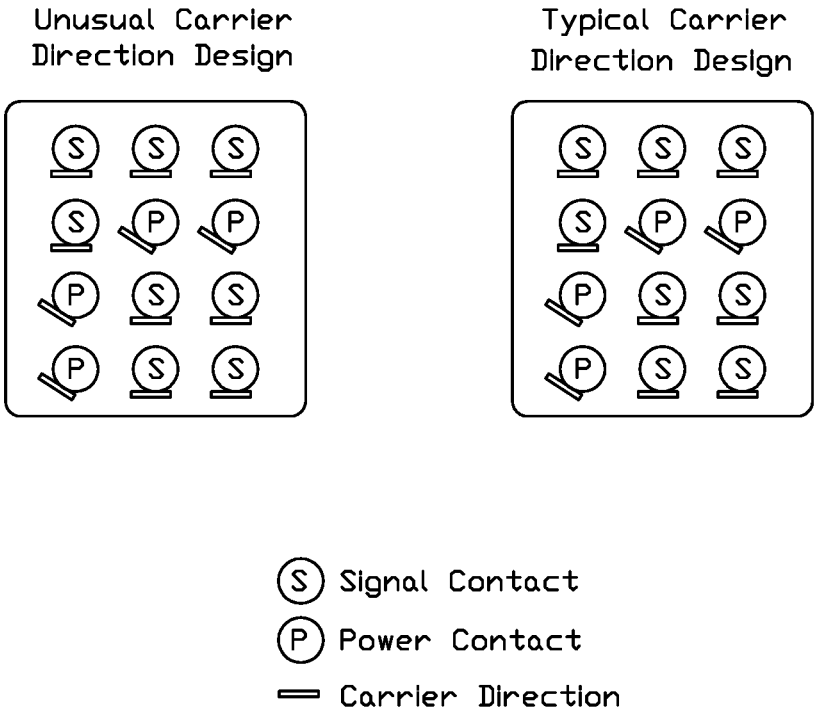
FIG. 16 illustrates the second embodiment.

FIG. 16 shows illustration of the second embodiment wherein the carriers of the power contacts extend in an oblique direction while the those of the signal contacts extend in the transverse direction and could be aligned together for one step installation.

Figure 17:
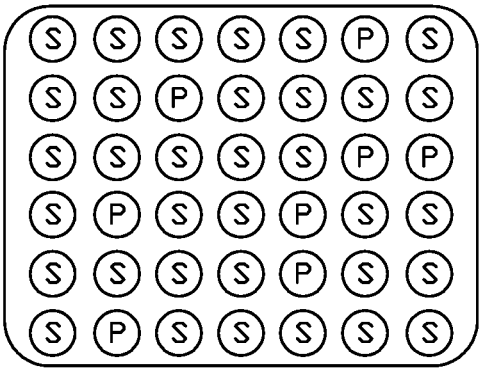
FIG. 17 illustrates the first embodiment and the third embodiment.

FIG. 17 shows illustration of the first embodiment wherein both the first type contacts and the second type contacts are installed into the corresponding passageways via a same fixture at one time, and that of the third embodiment wherein the first type contacts associated with the corresponding carriers are assembled into the corresponding passageways in the first vertical direction while the second type contacts associated with the corresponding carriers are assembled into the corresponding passageways in the second vertical direction opposite to the first vertical direction. Notably, the carriers of the first type contacts may be unified together and the carriers of the second type contacts may be unified together.

Figure 18:
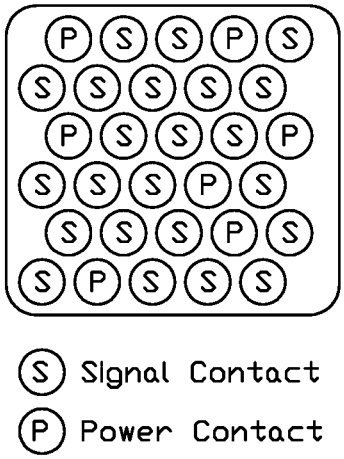
FIG. 18 illustrates the corresponding structures of the first embodiment.

FIG. 18 shows illustration of the first embodiment wherein the socket have two different type contacts with different deflections of the spring arms while aligned at the same height after loading of the CPU. The power contact has the smaller normal force than the signal contact even if under the larger deflection of the spring arm. The material and the thickness of the first type contact are different from those of the second type contact. The same passageways receive different type contacts. In this embodiment, the wiping action/distance of the power contact is larger than that of the signal contact because of the larger deflection thereof. Anyhow, the same wiping distance may be achieved if the dimension or configuration of the spring arm is specifically arranged. Understandably, the wiping distance may extend along a diagonal direction of the corresponding conductive pad of the CPU, if possible, as long as such a wiping action is always applied on the corresponding conductive pad. In this embodiment, the signal contact has the smaller yield stress than the power contact while having the larger elastic modulus than the power contact.

Figure 19:
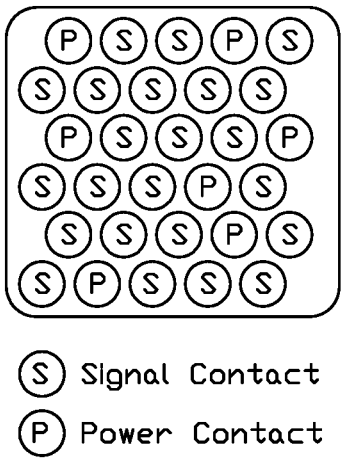
FIG. 19 illustrates the assembling method of the first embodiment.

FIG. 19 shows illustration of the first embodiment wherein the different type contacts associated with the carriers are commonly secured to the same fixture for installation into the corresponding passageways simultaneously.

Figure 20:
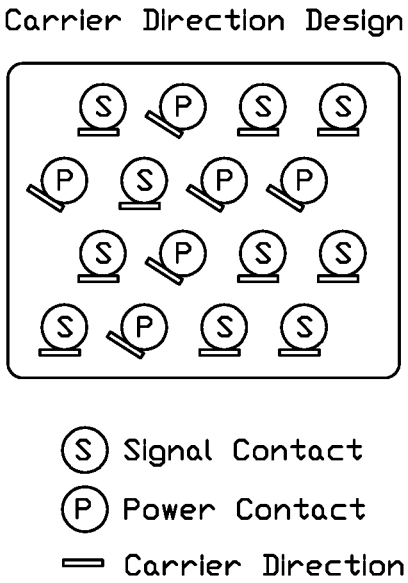
FIG. 20 illustrates the second embodiment.

FIG. 20 shows illustration of the second embodiment wherein the first type contacts associated with the first type carriers and the second type contacts associated with the second carriers could commonly exist on the housing without interference so as to allow installation of both type contacts before removal of the corresponding carriers. In other words, the firstly installed contacts and the corresponding carriers should not block the secondly installed contacts and the corresponding carriers. In this embodiment, the power contacts are firstly installed and the signal contacts are successively installed.

In brief, even though in the disclosed embodiments the power contact has less normal force than the signal contact, the opposite mutual relation may be another choice as long as two different normal forces exist on two different type contacts respectively that may facilitate perfection of the high frequency transmission with different arrangement approaches or other considerations. Another feature of the invention is to provide a plurality of contacts 100, 200 each originally having an unitary/integral holding part 110 which is assembled to the assembling part 10 and inserted into the corresponding passageway 310 of the housing 300 with other contacts 100, 200 wherein the holding part 110 can be removed/severed from the contacts 100, 200 after the contacts 100, 200 are assembled within the corresponding passageways 310 of the housing 300. Notably, the traditional contacts are essentially unitarily formed on the corresponding carrier and simultaneously inserted into the corresponding passageways of the housing by the carrier, and successively removed from the carrier after the contacts are completely assembled within the passageways of the housing. Understandably, in the traditional contact design, because the contact is required to be unitarily formed with the carrier for common insertion, there is some limitation to provide the properly configured contacting section or retaining section on the contact for meeting high frequency transmission. The instant invention uses the assembling part 10 and the holding part 110 to replace the traditional one-piece carrier for assembling a plurality of contacts into the corresponding passageways 310 of the housing 300, thus allowing more complexity of the configuration of the contact during forming the contact via sheet metal wherein such complex configuration of the contact may achieve the high frequency transmission advantageously.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector for upwardly coupling with a CPU (Central Processing Unit) having downwardly facing conductive pads on an undersurface thereof, comprising:

an insulative housing defining opposite top and bottom surfaces in a vertical direction;

a plurality of first type contacts retained in the housing with corresponding first spring arms extending above the top surface having corresponding upward first contacting sections thereon;

a plurality of second type contacts retained in the housing with corresponding second spring arms extending above the top surface having corresponding upward second contacting sections thereon; wherein the upward first contacting sections and the upward second contacting sections are either located at different heights in the vertical direction before confrontation with the corresponding conductive pads of the CPU; wherein each of the first type contacts has an upward connecting edge adjacent to the first spring arm for connecting to a first carrier which is used to downwardly assemble the first contact into the housing, and each of the second type contacts has an upward connecting edge adjacent to the second spring arm for connecting to a second carrier which is used to downwardly assemble the second contact int the housing; wherein both the upward connecting edge of the first type contact and the upward connecting edge of the second contact are flush with the top surface of the housing.

2. The electrical connector as claimed in claim 1, wherein during being fully coupled with the CPU, a first normal force of the first type contact with regard to the corresponding conductive pad is larger than a second normal force of the second type contact with regard to the corresponding conductive pad.

3. The electrical connector as claimed in claim 2, wherein the first type contact is of a signal contact and the second type contact is of a power contact.

4. The electrical connector as claimed in claim 1, wherein the first type contact is different from the second type contact by material, configuration or dimension.

5. The electrical connector as claimed in claim 1, wherein the first type contacts are signal contacts and the second type contacts are power contacts, and the second contacting sections are higher than the first contacting sections in the vertical direction.

6. The electrical connector as claimed in claim 1, wherein both the first contacting sections and the second contacting sections are downwardly pressed at a same level when the CPU is fully coupled therewith.

7. The electrical connector as claimed in claim 1, wherein the first carrier and the second carrier are discrete from each other while being commonly secured to a same assembly part for commonly assembling both the first type contact and the second type contact into the insulative housing simultaneously.

8. A contact assembly for use with an electrical connector with an insulative housing, comprising:

an assembling part;

a plurality of first contact assemblies each having a first type contact linked with a first holding part, all the first holding parts attached to the assembling part; and a plurality of second contact assemblies each having a second type contact linked with a second holding part, all the second holding parts attached to the assembling part; wherein all said first holding parts and said second holding parts are aligned together along a transverse direction so as to allow both the first type contacts and said second type contacts to be assembled into the housing in a vertical direction perpendicular to the transverse direction via the assembling part; wherein the first holding part is configured to be removed from the first type contact after the first type contact is substantially assembled within the correspond passageway, and the second holding part is configured to be removed from the second type contact after the second type contact is substantially assembled within the corresponding passageway.

9. The contact assembly as claimed in claim 8, wherein the first type contact is different from the second type contact.

10. The contact assembly as claimed in claim 9, wherein the first type contact includes an upward first contacting section, and the second type contact includes an upward second contacting section, the second contacting section being higher than the first contacting section in the vertical direction.

11. The contact assembly as claimed in claim 8, wherein the second type contact is a power contact while the first type contact is a signal contact.

12. An electrical connector assembly comprising:

an insulative housing forming a plurality of first passageways and a plurality of second passageways therein;

a plurality of first type contacts disposed in the corresponding passageways, respectively, each of said first type contacts being originally linked to a first holding part; and a plurality of second type contacts disposed in the corresponding passageways, respectively, each of said second type contacts originally linked to a second holding part; wherein in a top view, the first holding part extends in a first direction which is different from a second direction along which the second holding part extends.

13. The electrical connector assembly as claimed in claim 12, wherein the first type contact includes a planar first main body from which both a first contacting section and the first holding part extend while the second type contact includes a planar second main body from which a second contacting section extends and a planar auxiliary body which is angled with regard to the second main body and from which the second holding part extends.

14. The electrical connector assembly as claimed in claim 12, wherein the first type contact forms retention barbs on two sides of the planar first main body while the second type contact forms retention barbs on opposite outer sides of the second main body and the auxiliary body, respectively.

15. The electrical connector assembly as claimed in claim 12, wherein the first type contact includes a planar first main body from which a first contacting section extends, and a first auxiliary body angled with the first main body, and a first soldering pad, on which a solder ball is attached, extends from the first auxiliary body while the second type contact includes a planar second main body from which both a second contacting section and a second soldering pad extend.

* * * * *